US006205422B1

(12) United States Patent
Gu et al.

(10) Patent No.: US 6,205,422 B1
(45) Date of Patent: Mar. 20, 2001

(54) MORPHOLOGICAL PURE SPEECH DETECTION USING VALLEY PERCENTAGE

(75) Inventors: Chuang Gu, Redmond; Ming-Chieh Lee, Bellevue; Wei-ge Chen, Issaquah, all of WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/201,705

(22) Filed: Nov. 30, 1998

(51) Int. Cl.[7] ..... G10L 11/02; G10L 11/00
(52) U.S. Cl. ..... 704/233; 704/210; 704/213
(58) Field of Search ..... 704/233, 200, 704/210, 213

(56) References Cited

U.S. PATENT DOCUMENTS

| | | | | |
|---|---|---|---|---|
| 4,063,033 | * | 12/1977 | Harbert et al. | 381/94.1 |
| 4,281,218 | * | 7/1981 | Chuang et al. | 370/435 |
| 4,628,529 | * | 12/1986 | Borth et al. | 381/94.3 |
| 4,630,304 | * | 12/1986 | Borth et al. | 381/94.3 |
| 4,975,657 | * | 12/1990 | Eastmond | 330/279 |
| 5,208,864 | * | 5/1993 | Kaneda | 704/258 |
| 5,323,337 | * | 6/1994 | Wilson et al. | 702/73 |
| 5,479,560 | * | 12/1995 | Mekata | 704/209 |
| 5,550,924 | * | 8/1996 | Helf et al. | 381/94.3 |
| 5,826,230 | | 10/1998 | Reaves . | |
| 6,037,988 | | 3/2000 | Gu et al. . | |
| 6,075,875 | | 6/2000 | Gu . | |

OTHER PUBLICATIONS

Detection of Human Speech In Structured Noise, John D. Hoyt and Harry Wechsler, 1994.

(List continued on next page.)

*Primary Examiner*—David R. Hudspeth
*Assistant Examiner*—Daniel Abebe
(74) *Attorney, Agent, or Firm*—Klarquist Sparkman Campbell Leigh & Whinston, LLP

(57) ABSTRACT

A human speech detection method detects pure-speech signals in an audio signal containing a mixture of pure-speech and non-speech or mixed-speech signals. The method accurately detects the pure-speech signals by computing a novel Valley Percentage feature from the audio signal and then classifying the audio signals into pure-speech and non-speech (or mixed-speech) classifications. The Valley Percentage is a measurement of the low energy parts of the audio signal (the valley) in comparison to the high energy parts of the audio signal (the mountain). To classify the audio signal, the method performs a threshold decision on the value of the Valley Percentage. Using a binary mask, a high Valley Percentage is classified as pure-speech and a low Valley Percentage is classified as non-speech (or mixed-speech). The method further employs morphological filters to improve the accuracy of human speech detection. Before detection, a morphological closing filter may be employed to eliminate unwanted noise from the audio signal. After detection, a combination of morphological closing and opening filters may be employed to remove aberrant pure-speech and non-speech classifications from the binary mask resulting from impulsive audio signals in order to more accurately detect the boundaries between the pure-speech and non-speech portions of the audio signal. A number of parameters may be employed by the method to further improve the accuracy of human speech detection. For implementation in supervised digital audio signal applications, these parameters may be optimized by training the application a priori. For implementation in an unsupervised environment, adaptive determination of these parameters is also possible.

35 Claims, 6 Drawing Sheets

OTHER PUBLICATIONS

Construction And Evaluation Of A Robust Multifeature Speech/Music Discriminator, Eric Scheirer and Malcolm Slaney, 1997.

Real–Time Discrimination Of Broadcast Speech/Music, John Saunders, 1996.

Hoyt et al. "detection of human speech in structured noise" IEEE 1994, pp. 237–239.*

Defee et al., "Nonlinear Filters in Image Pyramid Generation," IEEE, pp. 269–272 (1991).

Gibson et al., *Digital Compression of Multimedia,* "Frequency Domain Speech and Audio Coding Standards," Chapter 8, pp. 263–290 (1988).

Gibson et al., *Digital Compression of Multimedia,* "Speech Quality and Intelligibility," Appendix A, pp. 419–426 (1998).

Gu, Chuang, "3D Contour Image Coding Based on Morphological Filters and Motion Estimation," ICASSP94, pp. 277–280 (1994).

Gu, Chuang, Multivalued Morphology and Segmentation–Based Coding, Ph.D. Dissertation (1995).

Gu et al., "Semantic Video Object Segmentation and Tracking Using Mathematical Morphology and Perspective Motion Model," ICIP 97, pp. 514–517 (Oct. 1997).

Salembier et al., "Region–based Video Coding Using Mathematical Morphology," Proceedings of the IEEE, vol. 83, No. 6, pp. 843–857.

Toklu et al., "Simultaneous Alpha Map Generation and 2–D Mesh Tracking for Multimedia Applications," ICIP 97, pp. 113–116 (Oct. 1997).

Wong, "Nonlinear Scale–Space Filtering and Multiresolution System," IEEE, pp. 774–787 (1995).

Yang, "Frequency Domain Noise Suppression Approaches in Mobile Telephone Systems," ICASSP '93, pp. 11–363–II 366 (1993).

* cited by examiner

110
INPUT AUDIO SIGNAL
S(t)
114
PRE-PROCESSOR COMPONENT
112
ENERGY COMPONENT
I(t)
116
FEATURE COMPUTATION COMPONENT
118
VALLEY PERCENTAGE FEATURE
VP(t)
122
BINARY SPEECH DECISION MASK
B(t)
120
DECISION PROCESSOR COMPONENT
124
POST-DECISION PROCESSOR COMPONENT
SPEECH DETECTION MASK
M(t)
126

PERSONAL COMPUTER
620
PROCESSING UNIT
621
SYSTEM MEMORY
622
623
625
RAM
ROM
624
OPERATING SYSTEM
635
636
APPLICATIONS
MODULES
637
DATA
638
632
INTERFACE
HARD DRIVE
627
633
INTERFACE
FLOPPY DRIVE
628
DISK
629
647
MONITOR
634
INTERFACE
CD-ROM DRIVE
630
DISK
631
640
KEYBOARD
642
MOUSE
VIDEO ADAPTER
648
SERIAL PORT INTERFACE
646
654
MODEM
652
WAN
649
REMOTE COMPUTER
651
LAN
NETWORK ADAPTER
653
MEMORY STORAGE
650

MORPHOLOGICAL PURE SPEECH DETECTION USING VALLEY PERCENTAGE

TECHNICAL FIELD

The invention relates to human speech detection by a computer, and more specifically relates to detecting pure-speech signals in an audio signal that may contain both pure-speech and mixed-speech or non-speech signals.

BACKGROUND OF THE INVENTION

Sounds typically contain a mix of music, noise, and/or human speech. The ability to detect human speech in sounds has important applications in many fields such as digital audio signal processing, analysis and coding. For example, specialized codecs (compression/decompression algorithms) have been developed for more efficient compression of pure sounds containing either music or speech, but not both. Most digital audio signal applications, therefore, use some form of speech detection prior to application of a specialized codec to achieve more compact representation of an audio signal for storage, retrieval, processing or transmission.

However, accurate detection of human speech by a computer in an audio signal produced by sounds containing a mix of music, noise and speech is not an easy task. Most existing speech detection methods use spectral and statistical analyses of the waveform patterns produced by the audio signal. The challenge is to identify features of the waveform patterns that reliably distinguish the pure-speech signals from the non-speech or mixed-speech signals.

For example, some existing methods of speech detection take advantage of a particular feature known as the zero-crossing rate (ZCR). See J. Saunders, "Real-time Discrimination of Broadcast Speech/Music", Proc. ICASSP'96, pp. 993–996, 1996. The ZCR feature provides a weighted average of the spectral energy distribution in the waveform. Human speech typically produces audio signals having a high ZCR, whereas other sounds, such as noise or music, do not. However, this feature may not always be reliable, as in the case of the sound of highly percussive music or structured noise, which can produce audio signals that have ZCRs indistinguishable from those of human speech.

Other existing methods employ several features, including the ZCR feature, in conjunction with elaborate statistical feature analysis, in an attempt to improve the accuracy of speech detection. See J. D. Hoyt and H. Wechsler, "Detection of Human Speech in Structured Noise", Proc. ICASSP'94, Vol. 11, 237–240, 1994; E. Scheirer and M. Slaney, "Construction and Evaluation of A Robust Multi-feature Speech/Music Discriminator", Proc. ICASSP'97, 1997.

While a great deal of research has focused on human speech detection, all of these existing methods fail to satisfy one or more of the following desirable characteristics of a speech detection system for modern multimedia applications: high precision, robustness, short time delay and low complexity.

High precision is desirable in digital audio signal applications because it is important to determine the nearly "exact" time when the speech starts and stops, or the boundaries, accurate to within less than a second. Robustness is desirable so that the speech detection system can process audio signals containing a mixture of sounds including noise, music, song, conversation, commercials, etc., all of which may be sampled at different rates without human intervention. Moreover, most digital audio signal applications are real-time applications. Thus, it is advantageous if the speech detection method employed provides results within a few seconds and with as little complexity as possible, for real-time implementation at a reasonable cost.

SUMMARY OF THE INVENTION

The invention provides an improved method for detecting human speech in an audio signal. The method employs a novel feature of the audio signal, identified as the Valley Percentage (VP) feature, that distinguishes the pure-speech signals from the non-speech and mixed-speech signals more accurately than existing known features. While the method is implemented in software program modules, it can also be implemented in digital hardware logic or in a combination of hardware and software components.

An implementation of the method operates on consecutive audio samples in a stream of samples by viewing a predetermined number of samples through a moving window of time. A Feature Computation component computes the value of the VP at each point in time by measuring the low energy parts of the audio signal (the valley) in comparison to the high energy parts of the audio signal (the mountain) for a particular audio sample relative to the surrounding audio samples in a given window. Intuitively, the VP is like the valley area among mountains. The VP is very useful in detecting pure-speech signals from non-speech or mixed-speech signals, because human speech tends to have a higher VP than other types of sounds such as music or noise.

After the initial window of samples is processed, the window is repositioned at (advanced to) the next consecutive audio sample in the stream. The Feature Computation component repeats the computation of the VP, this time using the next window of audio samples in the stream. The process of repositioning and computation is reiterated until a VP has been computed for each sample in the audio signal. A Decision Processor component classifies the audio samples into pure-speech or non-speech classifications by comparing the computed VP values against a threshold VP value.

In actual practice, human speech usually lasts for at least more than a few continuous seconds in real-world digital audio data. Thus, the accuracy of the speech detection is generally improved by removing those isolated audio samples classified as pure-speech, but whose neighboring samples are classified as non-speech, and vice versa. However, at the same time, it is desirable to preserve the sharp boundary between the speech and non-speech segments.

In the implementation, a Post-Decision Processor component accomplishes the foregoing by applying a filter to the binary speech decision mask (containing a string of "1"s and "0"s) generated by the Decision Processor component. Specifically, the Post-Decision Processor component applies a morphological opening filter followed by a morphological closing filter to the binary decision mask values. The result is the elimination of any isolated pure-speech or non-speech mask values (elimination of the isolated "1"s and "0"s). What remains is the desired speech detection mask identifying the boundaries of the pure-speech and non-speech portions of the audio signal.

Implementations of the method may include other features to improve the accuracy of the speech detection. For example, the speech detection method preferably includes a Pre-Processor component to clean the audio signal by filtering out unwanted noise prior to computing the VP feature.

In one implementation, a Pre-Processor component cleans the audio signal by first converting the audio signal to an energy component, and then applying a morphological closing filter to the energy component.

The method implements human speech detection efficiently in audio signals containing a mix of music, speech and noise, regardless of the sampling rate. For superior results, however, a number of parameters governing the window sizes and threshold values may be implemented by the method. Although there are many alternatives to determining these parameters, in one implementation, such as in supervised digital audio signal applications, the parameters are pre-determined by training the application a priori. A training audio sample with a known sampling rate and known speech boundaries is used to fix the optimal values of the parameters. In other implementations, such as implementation in an unsupervised environment, adaptive determination of these parameters is possible.

Further advantages and features of the invention will become apparent in the following detailed description and accompanying drawings.

DETAILED DESCRIPTION

Figure 1:
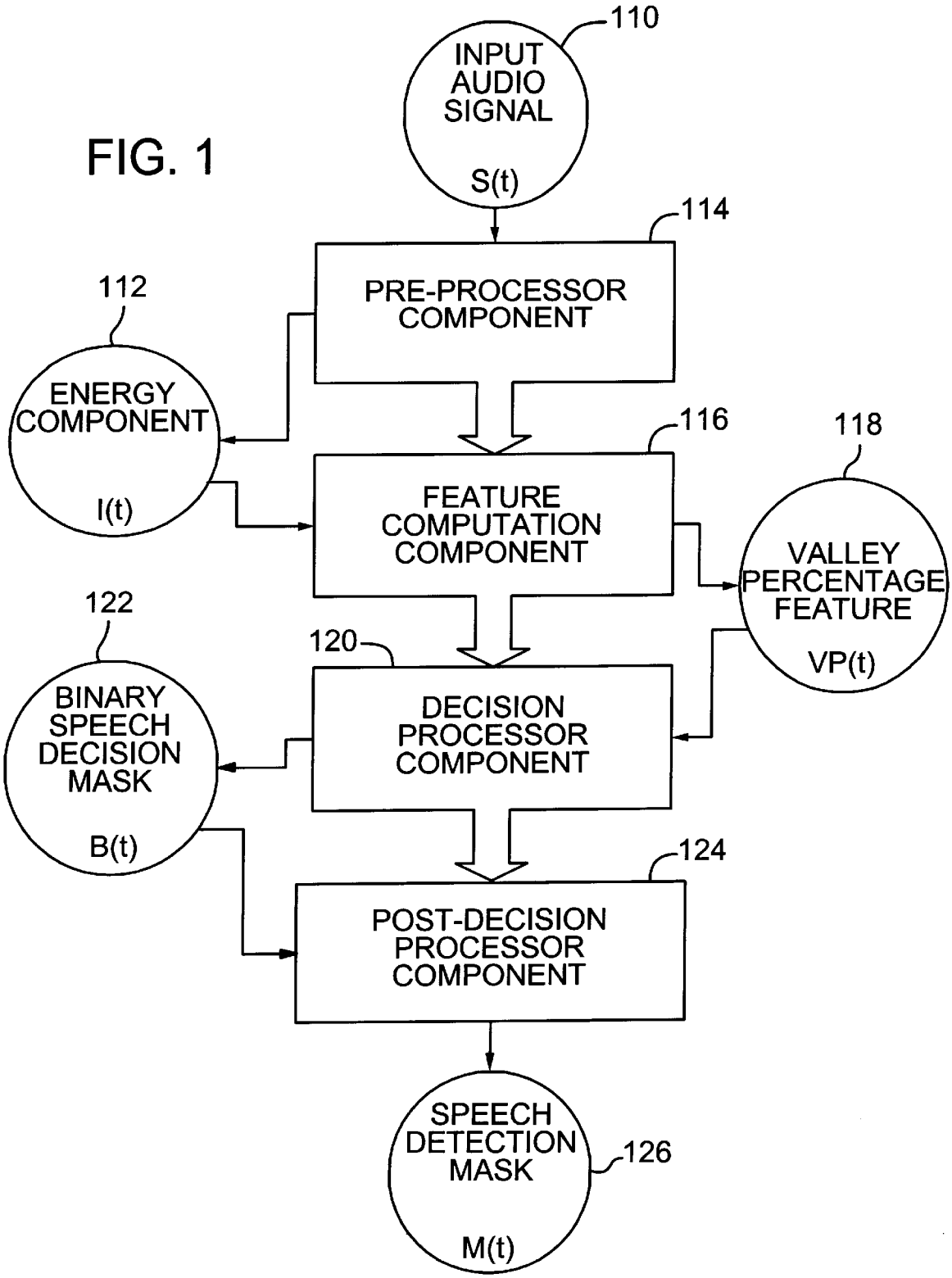
FIG. 1 is a general block diagram illustrating an overview of an implementation of human speech detection system.

Overview of a Method for Human Speech Detection

The following sections describe an improved method for detecting human speech in an audio signal. The method assumes that the input audio signal is comprised of a consecutive stream of discrete audio samples with a fixed sampling rate. The goal of the method is to detect the presence and span of pure-speech in the input audio signal.

Sounds generate audio signals having waveform patterns with certain characteristic features, depending upon the source of the sound. Most speech detection methods take advantage of this behavior by attempting to identify which features are reliably associated with human speech sounds. Unlike other human speech detection methods that employ existing known features, this improved method of human speech detection employs a novel feature identified as reliably associated with human speech sounds, referred to as the Valley Percentage (VP) feature.

Before describing an implementation of the speech detection method, it is helpful to begin with a series of definitions used throughout the rest of the description.

Definition 1 Window:

A window refers to a consecutive stream of a fixed number of discrete audio samples (or values derived from those audio samples). The method iteratively operates primarily on the middle sample located near a mid-point of the window, but always in relation to the surrounding samples viewed through the window at a particular point in time. As the window is repositioned (advanced) to the next consecutive audio sample, the audio sample at the beginning of the window is eliminated from view, and a new audio sample is added to the view at the end of the window. Windows of various sizes are employed to accomplish certain tasks. For example, the First Window is used in the Pre-Processor component to apply a morphological filter to the energy levels derived from the audio samples. A Second Window is used in the Feature Computation component to identify the maximum energy level within a given iteration of the window. A Third and Fourth Window are used in the Post-Decision Processor component to apply corresponding morphological filters to the binary speech decision mask derived from the audio samples.

Definition 2 Energy Component and Energy Level

The energy component is the absolute value of the audio signal. The energy level refers to a specific value of the energy component at time $t_n$ as derived from a corresponding audio sample at time $t_n$. Thus, where the audio signal is represented by S(t), the samples at time $t_n$ are represented by $S(t_n)$, the energy component is represented by I(t), the levels at time $t_n$ are represented by $I(t_n)$, and where $t=(t_1, t_2 \ldots t_n)$:

$$I(t) = \begin{cases} S(t) & S(t) \geq 0 \\ -S(t) & S(t) < 0 \end{cases}$$

Definition 3 Binary Decision Mask

The binary decision mask is a classification scheme used to classify a value into either a binary 1 or a binary 0. Thus, for example, where the binary decision mask is represented by B(t) and the binary values at time $t_n$ are represented as $B(t_n)$, and the valley percentage is represented by VP(t) and the VP values at time $t_n$ are represented as $VP(t_n)$, and β represents a threshold VP value, and where $t=(t_1, t_2 \ldots t_n)$:

$$B(t) = \begin{cases} 1\ \text{(speech)} & VP(t) > \beta \\ 0\ \text{(non-speech)} & VP(t) \leq \beta \end{cases}$$

Definition 4 Morphological Filters

Mathematical morphology is a powerful non-linear signal processing tool which can be used to filter undesirable characteristics from the input data while preserving its boundary information. In the method of the invention, mathematical morphology is effectively used to improve the accuracy of speech detection both in the Pre-Processor component, by filtering noise from the audio signal, and in the Post-Decision Processor component, by filtering out isolated binary decision masks resulting from impulsive audio samples.

More specifically, the morphological closing filter C(•) is composed of a morphological dilation operator D(•) followed by an erosion operator E(•) with a window W. Where the input data is represented by I(t) and the data values at time $t_n$ are represented as $I(t_n)$, and where $t=(t_1, t_2 \ldots t_n)$:

$$C(I(t)) = E(D(I(t)))$$

where $$E(I(t)) = \min_i \{I(i) \mid t - W \leq i \leq t + W\}$$

-continued $$D(I(t)) = \max_i \{I(i) \mid t - W \le i \le t + W\}$$

The morphological opening filter O(•) is composed of the same operators D(•) and E(•), but they are applied in the reverse order. Thus, where the input data is represented by I(t) and the data values at time $t_n$ are represented as $I(t_n)$, and where $t=(t_1, t_2 \ldots t_n)$:

$$O(I(t))=D(E(I(t)))$$

Example Implementation

The following sections describe a specific implementation of a human speech detection method in more detail. FIG. 1 is a block diagram illustrating the principal components in the implementation described below. Each of the blocks in FIG. 1 represent program modules that implement parts of the human speech detection method outlined above. Depending on a variety of considerations, such as cost, performance and design complexity, each of these modules may be implemented in digital logic circuitry as well.

Using the notation defined above, the speech detection method shown in FIG. 1 takes as input an audio signal S(t) 110. The Pre-Processor component 114 cleans the audio signal S(t) 110 to remove noise and convert it to an energy component I(t) 112. The Feature Computation component 116 computes a valley percentage VP(t) 118 from the energy component I(t) 112 for the audio signal S(t) 110. The Decision Processor component 120 classifies the resulting valley percentage VP(t) 118 into a binary speech decision mask B(t) 122 identifying the audio signal S(t) 110 as either pure-speech or non-speech. The Post-Decision Processor component 124 eliminates isolated values of the binary speech decision mask B(t) 122. The result of the Post-Decision Processor component is the speech detection mask M(t) 126.

Pre-Processor component

Figure 2:
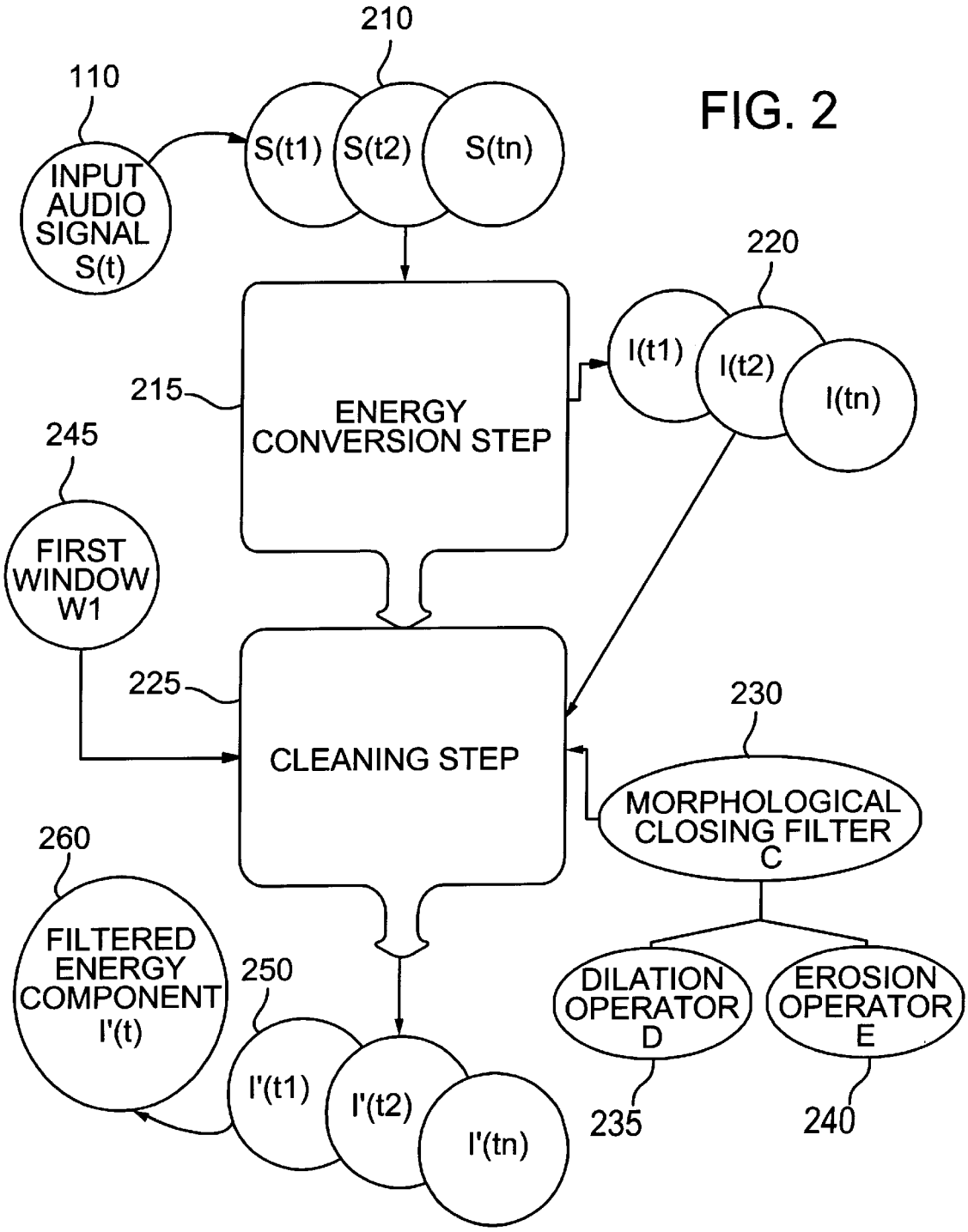
FIG. 2 is a block diagram illustrating an implementation of the Pre-Processor component of the system shown in FIG. 1.

The Pre-Processor component 114 of the method is shown in greater detail in FIG. 2. In the current implementation, the Pre-Processor component 114 begins the processing of an audio signal S(t) 110 by cleaning and preparing the audio signal S(t) 110 for subsequent processing. In particular, the current implementation iteratively operates on consecutive audio samples $S(t_n)$ 210 in a stream of samples of the audio signal S(t) 110 using the windowing technique (as previously defined in Definition 1). The Pre-Processor component 114 begins by performing the energy conversion step 215. In this step, each of the audio samples $S(t_n)$ 210 at time $t_n$ is converted into corresponding energy levels $I(t_n)$ 220 at time $t_n$. The energy levels $I(t_n)$ 220 at time $t_n$ are constructed from the absolute value of the audio samples $S(t_n)$ 210 at time $t_n$, where $t=t_1, t_{2, \ldots m}$ as follows:

$$I(t) = \begin{cases} S(t) & S(t) \ge 0 \\ -S(t) & S(t) < 0 \end{cases}$$

The Pre-Processor component 114 next performs a cleaning step 225 to clean the audio signal S(t) 110 by filtering the energy component I(t) 112 in preparation for further processing. In designing the Pre-Processor component, it is preferable to select a cleaning method that does not introduce spurious data. The current implementation uses a morphological closing filter, C(•) 230, which (as previously defined in Definition 4) is the combination of morphological dilation operator D(•) 235 followed by an erosion operator E(•) 240. The cleaning step 225 applies C(•) 230 to the input audio signal S(t) 110 by operating on each of the energy levels $I(t_n)$ 220 corresponding to each of the audio samples $S(t_n)$ 210 at time $t_n$ using a First Window $W_1$ 245 of a pre-determined size, where $t=t_1, t_2, \ldots t_n$ as follows:

$$C(I(t)) = D(E(I(t)))$$

where $$E(I(t)) = \min_i \{I(i) \mid t - W_1 \le i \le t + W_1\}$$

$$D(I(t)) = \max_i \{I(i) \mid t - W_1 \le i \le t + W_1\}$$

As can be seen, the closing filter C(•) 230 computes the each of the filtered energy levels $I'(t_n)$ 250 by first dilating each of the energy levels $I(t_n)$ 220 at time $t_n$ to the maximum surrounding energy levels in the First Window $W_1$ 245, and then eroding the dilated energy levels to the minimum surrounding energy levels in the First Window $W_1$ 245.

The morphological closing filter C(•) 230 cleans unwanted noise from the input audio signal S(t) 110 without blurring the boundaries between the different types of audio content. In one implementation, the application of the morphological closing filter C(•) 230 can be optimized by sizing the First Window $W_1$ 245 to suit the particular audio signal being processed. In a typical implementation the optimal size of the First Window $W_1$ 245 is predetermined by training the particular application in which the method is employed with audio signals having known speech characteristics. As a result, the speech detection method can more effectively identify boundaries of pure-speech and non-speech in an audio signal.

Feature Computation

In the current implementation, after the Pre-Processing component cleans the input audio signal S(t) 110, the Feature Computation component computes a distinguishing feature.

In implementing a component to compute a feature of an audio signal that will reliably distinguish pure-speech from non-speech, there are many issues to address. First, which components of an audio signal are capable of revealing reliable characteristics that can distinguish the pure-speech signal from the non-speech signal? Second, how can that component be manipulated to quantify the distinguishing characteristic? Third, how can the manipulation be parameterized to optimize the results for a variety of audio signals?

The literature relating to human speech detection describe a variety of features which can be used to distinguish human speech in an audio signal. For example, most existing speech detection methods use, among others, spectral analysis, cepstral analysis, the aforementioned zero-crossing rate, statistical analysis, or format tracking, either alone or in combination, just to name a few.

These existing methods may provide satisfactory results in some digital audio signal applications, but they do not guarantee an accurate result for a wide variety of audio signals containing a mixture of sounds including noise, music (structured noise), song, conversation, commercials, etc., all of which may be sampled at different rates with human intervention. The identification of a reliable feature is crucial because the accuracy with which the audio signal can be classified is dependent upon the robustness of the feature.

Preferably, after performing the Feature Computation and Decision Processor components, the speech detection method will have classified all audio samples correctly, regardless of the source of the audio signal. The boundaries identifying the start and stop of speech signals in an audio signal are dependant upon the correct classification of the neighboring samples, and the correct classification is dependant not only upon the reliability of the feature, but also the accuracy with which it is computed. Therefore, the feature computation directly impacts the ability to detect speech. If the feature is incorrect, then the classification of the audio sample may be incorrect as well. Accordingly, the Feature Computation component of the method should provide an accurate computation of a distinguishing feature.

In considering the above, it is apparent that the existing methods may be very difficult to implement in a real-time digital audio signal application, not only because of their complexity, but also because of the increased time delay between the input of the audio signal and the detection of speech that such complexity will inevitably introduce. Moreover, the existing methods may be incapable of fine-tuning the speech detection capability due to the limitations of the distinguishing feature(s) employed and/or the inability to parameterize the implementation so as to optimize the results for a particular source of the audio signal. The current implementation of a Feature Computation component 116 addresses these shortcomings as detailed below.

The feature computed by the current implementation of the Feature Computation component 116 is the Valley Percentage (VP) feature referred to in FIG. 1 as VP(t) 118. Human speech tends to have higher value of VP. Therefore, the VP feature is an effective feature to distinguish the pure-speech signals from the non-speech signals. Moreover, the VP is also relatively simple to compute, and is therefore capable of implementation in real-time applications.

Figure 3:
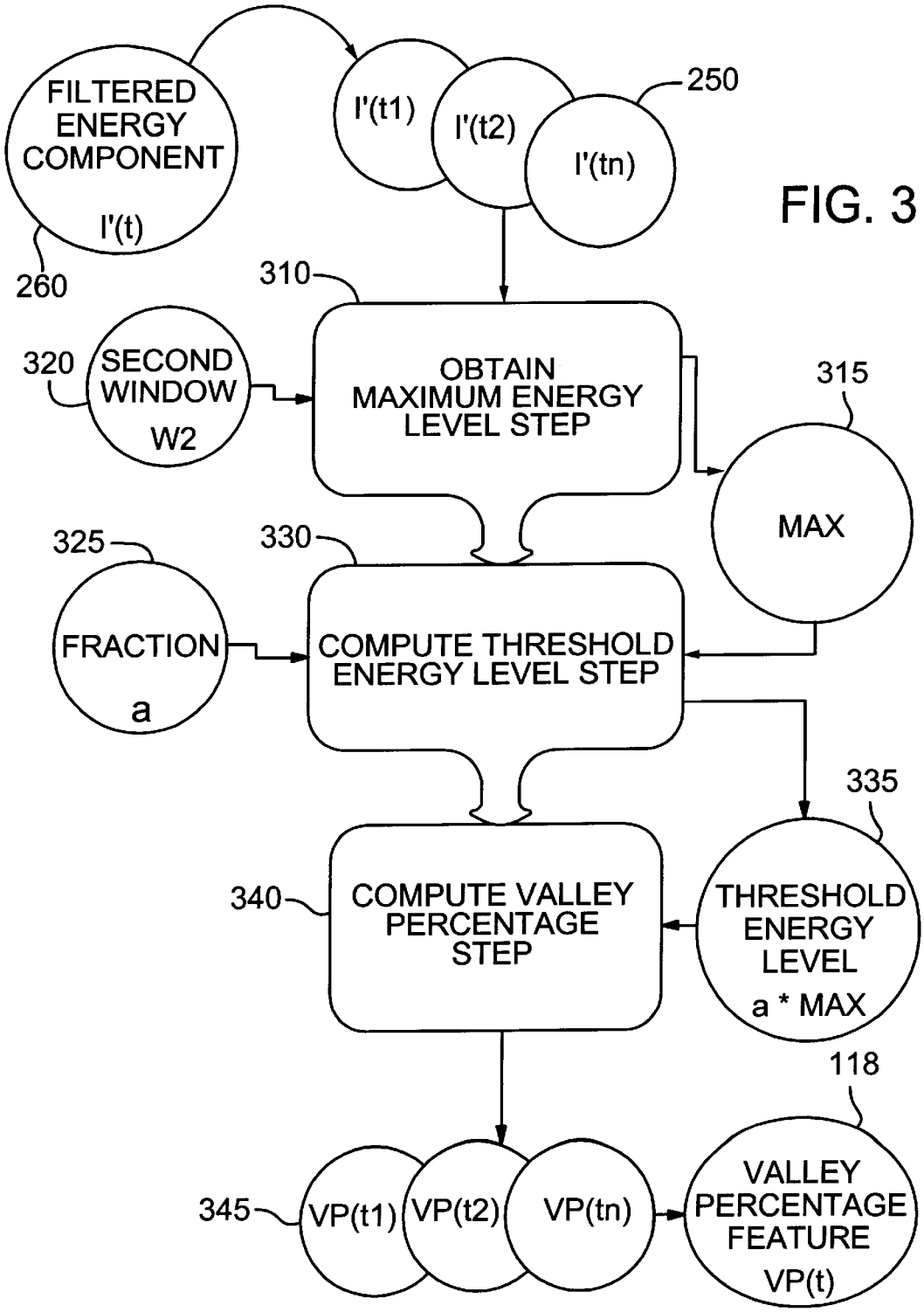
FIG. 3 is a block diagram illustrating an implementation of the Feature Computation component of the system shown in FIG. 1.

The Feature Computation component 116 of the current implementation is further illustrated in FIG. 3. To compute the value of the VP(t) 118 for the input audio signal S(t) 110, the Feature Computation component 116 calculates the percentage of all of the audio samples $S(t_n)$ 210 whose filtered energy levels $I'(t_n)$ 250 at time $t_n$ fall below a threshold energy level 335 in Second Window $W_2$ 320.

Following the diagram in FIG. 3, the Feature Computation component first performs the identify maximum energy level step 310 to identify the maximum energy level Max 315 appearing in the Second Window $W_2$ 320 among all of the filtered energy levels $I'(t_n)$ 250 at time $t_n$. The compute threshold energy step 330 computes the threshold energy level 335 by multiplying the identified maximum energy level Max 315 by a predetermined numerical fraction α 325.

Finally, the compute valley percentage step 340 computes the percentage of all of the filtered energy levels $I'(t_n)$ 250 at time $t_n$ appearing in the Second Window $W_2$ 320 that fall below the threshold energy level 335. The resulting VP values $VP(t_n)$ 345 corresponding to each audio sample $S(t_n)$ 210 at time $t_n$ is referred to as the valley percentage feature VP(t) 118 of the corresponding audio signal S(t) 110.

The computation of the valley percentage feature VP(t) 118 is expressed below using the following notation:

I'(t) for the filtered energy component 260;

$W_2$ for the Second Window 320;

Max for the maximum energy level 315;

α for the predetermined numerical fraction 325;

N(i) to represent a summation of the number of energy levels below the threshold; and VP(t) for the valley percentage 118.

$$VP(t) = \frac{\sum_{i=t-W_2}^{t+W_2} N(i)}{2W_2+1}; \quad N(i) = \begin{cases} 1 & I'(t) < \alpha * \text{Max} \\ 0 & I'(t) \geq \alpha * \text{Max} \end{cases}$$

$$\text{Max} = \max_i \{I'(i) \mid t - W_2 \leq i \leq t + W_2\}$$

The Feature Computation component steps 310, 330 and 340 are reiterated for each of the filtered energy levels $I'(t_n)$ 250 at time $t_n$, by advancing the Second Window $W_2$ 320 to each of the subsequent audio samples $S(t_{n+1})$ 210 at time $t_{n+1}$ in the input audio signal S(t) 110 (and as defined in Definition 1). By modifying the size of the Second Window $W_2$ 320 and the value of the numerical fraction α 325, the computation of the VP(t) 118 can be optimized to suit a variety of sources of audio signals.

Decision Processor Component

The Decision Processor component is a classification process which operates directly on VP(t) 118 as computed by the Feature Computation component. The Decision Processor component 120 classifies the computed VP(t) 118 into pure-speech and non-speech classifications by constructing a binary speech decision mask B(t) 122 for the VP(t) 118 corresponding to the audio signal S(t) 110 (see definition of binary decision mask in Definition 3).

Figure 4:
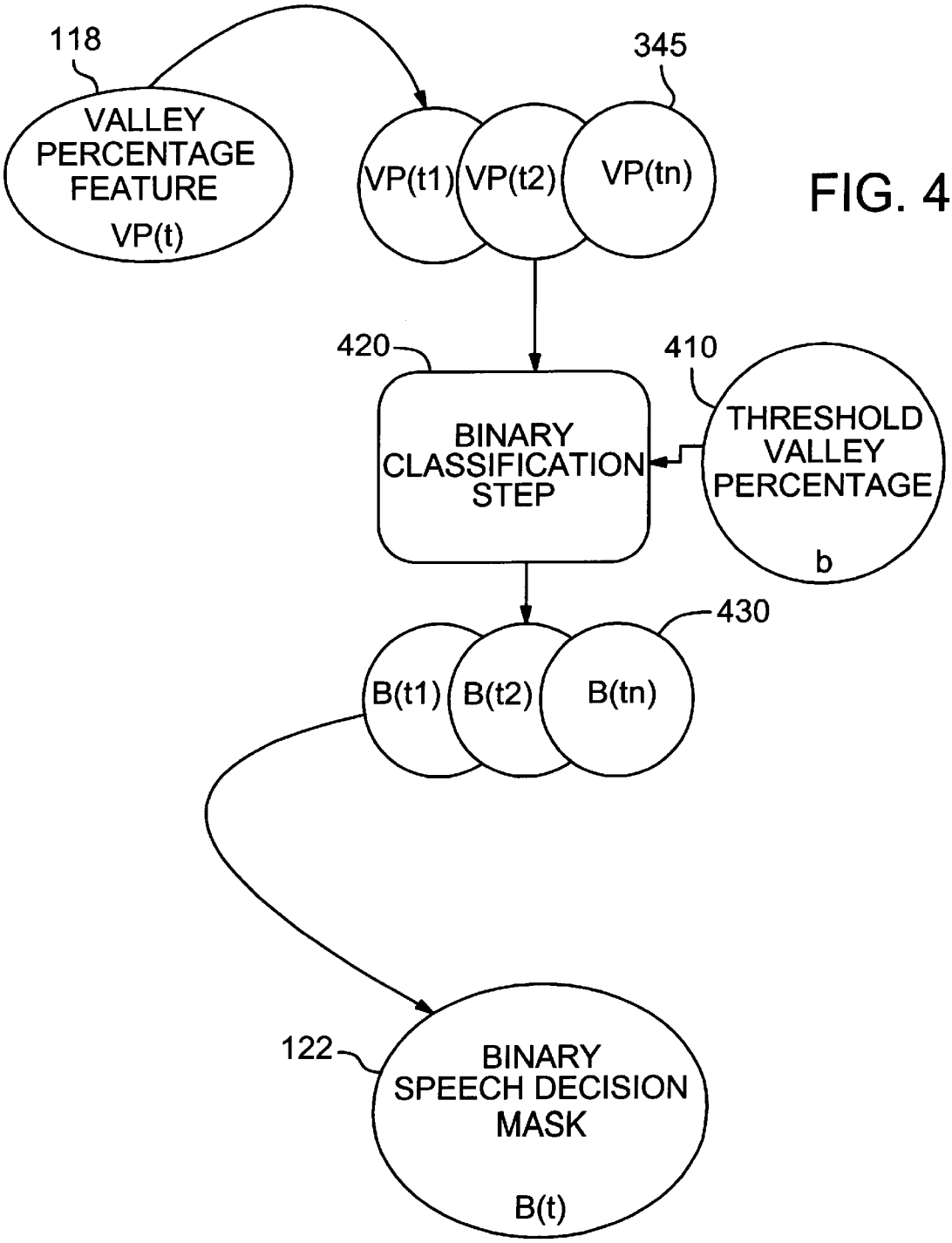
FIG. 4 is a block diagram illustrating an implementation of Decision Processor component of the system shown in FIG. 1.

FIG. 4 is a block diagram further illustrating the construction of the speech decision mask B(t) 122 from the VP(t) 118. More specifically, the Decision Processor component 120 performs a binary classification step 420 which compares each of the VP values $VP(t_n)$ 345 at time $t_n$ to a threshold valley percentage β 410. When one of the VP values $VP(t_n)$ 345 at time $t_n$ is less than or equal to the threshold valley percentage β 410, the corresponding value of the speech decision mask $B(t_n)$ 430 at time $t_n$ is set equal to the binary value "1". When one of the VP values $VP(t_n)$ 345 at time $t_n$ is greater than the threshold valley percentage β 410, the corresponding value of the speech decision mask $B(t_n)$ 430 at time $t_n$ is set equal to the binary value "0".

The classification of the valley percentage feature VP(t) 118 into a binary speech decision mask B(t) 122 is expressed below, using the following notation:

VP(t) for the valley percentage 118;

B(t) for the binary speech decision mask 122; and

β for the threshold valley percentage 410.

$$B(t) = \begin{cases} 1 \text{ (speech)} & VP(t) > \beta \\ 0 \text{ (non-speech)} & VP(t) \leq \beta \end{cases}$$

The Decision Processor 120 component reiterates the binary classification step 420 until all VP values $VP(t_n)$ 345 corresponding to each audio sample $S(t_n)$ 210 at time $t_n$ have been classified as either pure-speech or non-speech. The resulting string of binary decision masks $B(t_n)$ 430 at time $t_n$ is referred to as the speech decision mask B(t) 122 of the audio signal S(t) 110. The binary classification step 420 can be optimized by varying the threshold valley percentage β 410 to suit a wide variety of sources of the audio signal S(t) 110.

Post-Decision Processor Component

Once the Decision Processor component 120 has generated the binary speech decision mask B(t) 122 for the audio signal S(t) 110, it would seem there is little else to do. However, as previously noted, the accuracy of speech detection may be further improved by conforming to the non-speech classification those isolated audio samples classified as pure-speech, but whose neighboring samples are classified as non-speech, and vice versa. This flows from the observation, previously noted, that human speech usually lasts for at least more than a few continuous seconds in the real world.

The Post-Decision Processor component 124 of the current implementation takes advantage of this observation by applying a filter to the speech detection mask generated by the Decision Processor component 120. Otherwise, the resulting binary speech decision mask B(t) 122 will likely be peppered with anomalous small isolated "gaps" or "spikes," depending upon the quality of the input audio signal S(t) 110, thereby rendering the result potentially useless for some digital audio signal applications.

As described in the current implementation of the cleaning filter present in the Pre-Processor component 114, the current implementation of the Post-Decision Processor also uses morphological filtration to achieve superior results. Specifically, the current implementation applies two morphological filters, in succession, for conforming the individual speech decision mask value $B(t_n)$ 430 to its neighboring speech decision mask values $B(t_{n\pm1})$ at time $t_n$ (eliminating the isolated "1"s and "0"s), while at the same time preserving the sharp boundary between the pure-speech and non-speech samples. One filter is the morphological closing filter, C(•) 560, similar to the previously described closing filter 230 in the Pre-Processing component 114 (and as further defined in Definition 4). The other filter is the morphological opening filter O(•) 520, which is similar to the closing filter 560, except that the erosion and dilation operators are applied in the reverse order—the erosion operator, first, followed by the dilation operator, second (and as further defined in Definition 4).

Figure 5:
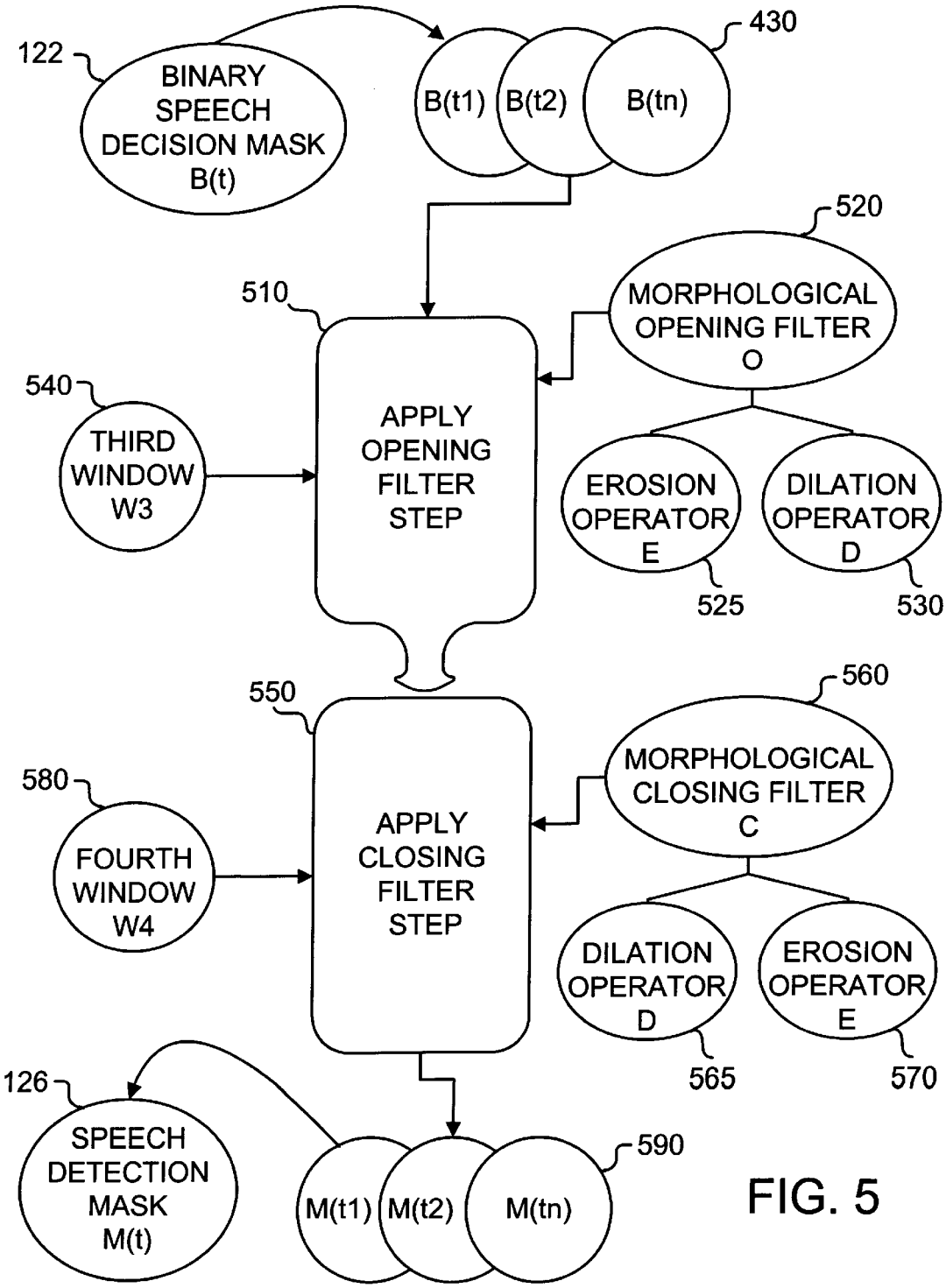
FIG. 5 is a block diagram illustrating an implementation of the Post-Decision Processor component of the system shown in FIG. 1.

Referring to FIG. 5, the Post-Decision Processor component performs the apply opening filter step 510 which applies the morphological opening filter O(•) 520 to each of the binary speech decision mask values $B(t_n)$ 430 at time $t_n$ using a Third Window $W_3$ 540 of a pre-determined size:

$$O(B(t))=D(E(B(t))), \text{ where}$$

$$E(D(B(t)) = \min_i\{B(i) \mid t - W_3 \le i \le t + W_3\}$$

$$D(B(t)) = \max_i\{B(i) \mid t - W_3 \le i \le t + W_3\}$$

As can be seen, the morphological opening filter O(•) 520 computes the "opened" value of the binary speech decision mask B(t) 122 by first applying the erosion operator E 525 and then the dilation operator D 530 to the binary speech decision mask value $B(t_n)$ 430 at time $t_n$. The erosion operator E 535 erodes the binary decision mask value $B(t_n)$ 430 at time $t_n$ to the minimum surrounding mask values in the Third Window $W_3$ 540. The dilation operator D 530 dilates the eroded decision mask value $B(t_n)$ 430 at time $t_n$ to the maximum surrounding mask values in the Third Window $W_3$ 540.

The Post-Decision Processor component then applies the morphological closing filter C(•) 560 to each "opened" binary speech decision mask value $O(B(t_n))$ at time $t_n$ using a Fourth Window $W_4$ 580 of a pre-determined size:

$$C(O(B(t)))=E(D(O(B(t)))) \text{ where}$$

$$D(O(B(t))) = \max_i\{O(B(i)) \mid t - W_4 \le i \le t + W_4\}$$

$$E(D(O(B(t)))) = \min_i\{D(O(B(i))) \mid t - W_4 \le i \le t + W_4\}$$

As can be seen, the morphological closing filter C(•) 560 computes the "closed" value of the binary speech decision mask B(t) 122 by first applying the dilation operator D 530 and then the erosion operator E 525 to the binary speech decision mask value $B(t_n)$ 430 at time $t_n$. The dilation operator D 565 dilates the "opened" binary decision mask value $B(t_n)$ 430 at time $t_n$ to the maximum surrounding mask values in the Fourth Window $W_4$ 580. The erosion operator E 570 erodes the "opened" binary decision mask value $B(t_n)$ 430 at time $t_n$ to the minimum surrounding mask values in the Fourth Window $W_4$ 580.

The result of performing the Post-Decision Processor component 124 is the final estimate of the binary speech detection mask values $M(t_n)$ 590 corresponding to each audio sample $S(t_n)$ 210 at time $t_n$ as expressed below:

$$M(t)=C(O(B(t)))$$

By using morphological filters as described in the Post-Decision Processor component, aberrations in the audio signal S(t) 110 can be conformed to neighboring portions of the signal without blurring the pure-speech and non-speech boundaries. The result is an accurate speech detection mask M(t) 126 indicating the start and stop boundaries of human speech in the audio signal S(t) 110. Moreover, the morphological filters applied by the Post-Decision Processor component can be optimized by sizing the Third Window $W_3$ 540 and Fourth Window $W_4$ 580 to suit the particular audio signal being processed. In a typical implementation the optimal size of the Third Window $W_3$ 540 Fourth Window $W_4$ 580 is predetermined by training the particular application in which the method is employed with audio signals having known speech characteristics. As a result, the speech detection method can more effectively identify the boundaries of pure-speech and non-speech signals in an audio signal S(t) 110.

Parameter Setting

As alluded to in the background section, human speech detection in an audio signal relates to digital audio compression because audio signals typically contain both pure-speech and non-speech or mixed-speech signals. Just as the specialized speech codecs compress a pure-speech signal more accurately than a non-speech or mixed-speech signal, the present invention detects human speech more accurately in an audio signal which has been pre-processed, or filtered, to remove noise than one which has not. For the purposes of this invention, the precise method used for pre-processing or filtering noise from the audio signal is unimportant. In fact, the method for detecting human speech in an audio signal described herein and claimed below are relatively independent of the specific implementation of noise reduction. In the context of the invention, although it does not matter whether noise is present, it may change the setting of the parameters implemented in the method.

As noted in the background section, the setting of the parameters for window sizes and threshold values should be chosen so that the accuracy of the detection of pure-speech is optimized. In a superior implementation, the accuracy of detection of pure-speech is at least 95%.

In one implementation the parameters may be determined through training. For the training audio signal, the actual boundaries of the pure-speech and non-speech samples are known, referred to here as the ideal output. So the parameters are optimized for ideal output.

For example, assume the ideal output is M(t), a full search in the parameter space ($W_1$, $W_2$, $W_3$, $W_4$, $\alpha$, $\beta$) leads to the setting of these values:

$$\min_{W_1,W_2,W_3,W_4,\alpha,\beta}\{\|M(t)-M(I(t),W_1,W_2,W_3,W_4,\alpha,\beta)\|\}$$

Assuming further, that the training audio signal produced by a particular sound source has a sampling rate of F kHz, the optimal relationship of the parameters for and the sampling rate is shown below.

$W_1$=40*F/8, $W_2$=2000*F/8, $W_3$=24000*F/8, $W_4$=32000*F/8, $\alpha$=10%, and $\beta$=10%.

Brief Overview of a Computer System

Figure 6:
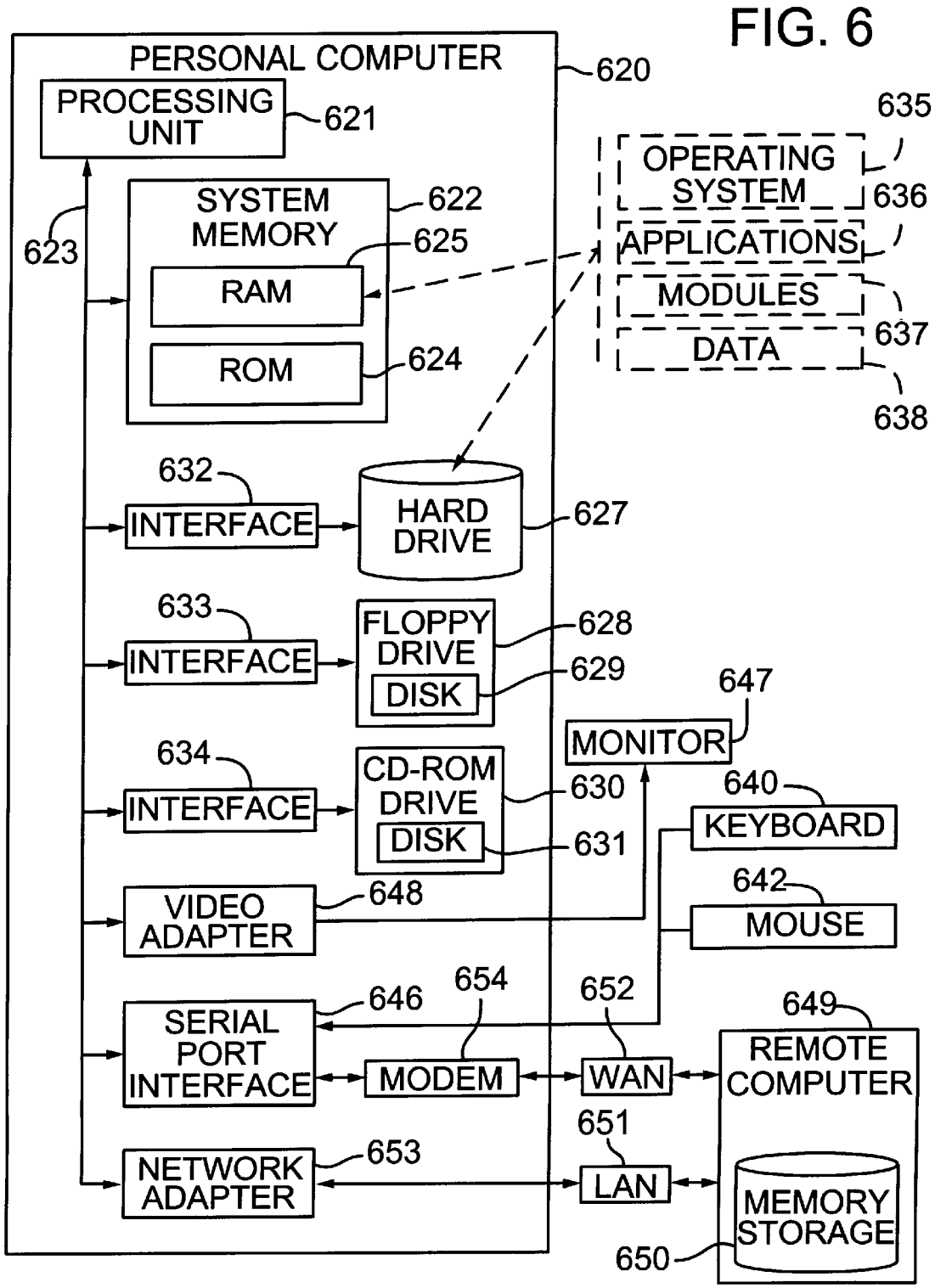
FIG. 6 is a block diagram of a computer system that serves as an operating environment for an implementation of the invention.

FIG. 6 and the following discussion are intended to provide a brief, general description of a suitable computing environment in which the invention may be implemented. Although the invention or aspects of it may be implemented in a hardware device, the tracking system described above is implemented in computer-executable instructions organized in program modules. The program modules include the routines, programs, objects, components, and data structures that perform the tasks and implement the data types described above.

While FIG. 6 shows a typical configuration of a desktop computer, the invention may be implemented in other computer system configurations, including hand-held devices, multiprocessor systems, microprocessor-based or programmable consumer electronics, minicomputers, mainframe computers, and the like. The invention may also be used in distributed computing environments where tasks are performed by remote processing devices that are linked through a communications network. In a distributed computing environment, program modules may be located in both local and remote memory storage devices.

FIG. 6 illustrates an example of a computer system that serves as an operating environment for the invention. The computer system includes a personal computer 620, including a processing unit 621, a system memory 622, and a system bus 623 that interconnects various system components including the system memory to the processing unit 621. The system bus may comprise any of several types of bus structures including a memory bus or memory controller, a peripheral bus, and a local bus using a bus architecture such as PCI, VESA, Microchannel (MCA), ISA and EISA, to name a few. The system memory includes read only memory (ROM) 624 and random access memory (RAM) 625. A basic input/output system 626 (BIOS), containing the basic routines that help to transfer information between elements within the personal computer 620, such as during start-up, is stored in ROM 624. The personal computer 620 further includes a hard disk drive 627, a magnetic disk drive 628, e.g., to read from or write to a removable disk 629, and an optical disk drive 630, e.g., for reading a CD-ROM disk 631 or to read from or write to other optical media. The hard disk drive 627, magnetic disk drive 628, and optical disk drive 630 are connected to the system bus 623 by a hard disk drive interface 632, a magnetic disk drive interface 633, and an optical drive interface 634, respectively. The drives and their associated computer-readable media provide nonvolatile storage of data, data structures, computer-executable instructions (program code such as dynamic link libraries, and executable files), etc. for the personal computer 620. Although the description of computer-readable media above refers to a hard disk, a removable magnetic disk and a CD, it can also include other types of media that are readable by a computer, such as magnetic cassettes, flash memory cards, digital video disks, Bernoulli cartridges, and the like.

A number of program modules may be stored in the drives and RAM 625, including an operating system 635, one or more application programs 636, other program modules 637, and program data 638. A user may enter commands and information into the personal computer 620 through a keyboard 640 and pointing device, such as a mouse 642. Other input devices (not shown) may include a microphone, joystick, game pad, satellite dish, scanner, or the like. These and other input devices are often connected to the processing unit 621 through a serial port interface 646 that is coupled to the system bus, but may be connected by other interfaces, such as a parallel port, game port or a universal serial bus (USB). A monitor 647 or other type of display device is also connected to the system bus 623 via an interface, such as a display controller or video adapter 648. In addition to the monitor, personal computers typically include other peripheral output devices (not shown), such as speakers and printers.

The personal computer 620 may operate in a networked environment using logical connections to one or more remote computers, such as a remote computer 649. The remote computer 649 may be a server, a router, a peer device or other common network node, and typically includes many or all of the elements described relative to the personal computer 620, although only a memory storage device 50 has been illustrated in FIG. 5. The logical connections depicted in FIG. 5 include a local area network (LAN) 651 and a wide area network (WAN) 652. Such networking environments are commonplace in offices, enterprise-wide computer networks, intranets and the Internet.

When used in a LAN networking environment, the personal computer 620 is connected to the local network 651 through a network interface or adapter 653. When used in a WAN networking environment, the personal computer 620 typically includes a modem 654 or other means for establishing communications over the wide area network 652, such as the Internet. The modem 654, which may be internal or external, is connected to the system bus 623 via the serial port interface 646. In a networked environment, program modules depicted relative to the personal computer 620, or portions thereof, may be stored in the remote memory storage device. The network connections shown are merely examples and other means of establishing a communications link between the computers may be used.

In view of the many possible implementations to which the principles of our invention may be applied, we emphasize that the implementations described above are only examples of the invention and should not be taken as a limitation on the scope of the invention. Rather, the scope of the invention is defined by the following claims. We therefore claim as our invention all that comes within the scope and spirit of these claims.

We claim:

1. A method for detecting pure speech signals in an audio signal having pure speech and non-speech or mixed-speech signals, the method comprising:

computing from the audio signal a valley percentage feature, the valley percentage feature representing for a point in the audio signal a proportion of plural surrounding points that are low energy surrounding points, wherein a low energy surrounding point has an energy level that falls below a threshold energy level for the plural surrounding points;

classifying the audio signal into either a pure-speech or non-speech classification according to the valley percentage feature; and determining the boundaries between a portion of the audio signal classified as pure-speech and a portion of the audio signal classified as non-speech.

2. The method of claim 1 wherein the audio signal is filtered to produce a clean audio signal before computing the valley percentage feature, where the clean audio signal retains distinct boundaries between the pure-speech and non-speech portions, yet with less noise.

3. The method of claim 2 wherein the filtering of the audio signal includes:

converting the audio signal into an energy component having a plurality of energy levels, wherein each energy level corresponds to an audio sample of the audio signal; and applying a morphological closing filter to each energy level of the energy component to produce a filtered energy component of the audio signal.

4. The method of claim 3 wherein the energy component of the audio signal is constructed by assigning to each energy level of the energy component, the absolute value of the corresponding audio sample of the audio signal.

5. A computer-readable medium having instructions for performing the steps of claim 1.

6. A method for detecting pure speech signals in an audio signal having pure speech and non-speech or mixed-speech signals, the method comprising:

filtering the audio signal to produce a clean audio signal, where the clean audio signal retains distinct boundaries between the pure-speech and non-speech portions, yet with less noise, wherein the filtering includes:

converting the audio signal into an energy component having a plurality of energy levels, wherein each energy level corresponds to an audio sample of the audio signal; and applying a morphological closing filter to each energy level of the energy component to produce a filtered energy component of the audio signal by, positioning a first window over a plurality of energy levels such that a first energy level is positioned near a mid-point of the first window;

dilating the first energy level to a maximum energy level of the surrounding energy levels viewed through the first window;

repositioning the first window over a plurality of energy levels to a next consecutive energy level such that the next consecutive energy level is positioned near a mid-point of the first window;

repeatedly performing the dilating and repositioning until all of the energy levels of the energy component have been dilated;

repositioning the first window over the first energy level;

eroding the first energy level to a minimum energy level of the surrounding energy levels viewed through the first window;

repositioning the first window over a plurality of energy levels to the next consecutive energy level; and repeatedly performing the eroding and repositioning until all of the energy levels of the energy component have been eroded, resulting in a plurality of filtered energy levels of the energy component;

computing from the audio signal a valley percentage feature;

classifying the audio signal into either a pure-speech or non-speech classification according to the valley percentage feature; and determining the boundaries between a portion of the audio signal classified as pure-speech and a portion of the audio signal classified as non-speech.

7. The method of claim 6 wherein the first window is a duration of time selected by minimizing a difference between a known boundary of pure-speech and non-speech portions of a training audio signal and a test boundary determined across a parameter space.

8. The method of claim 6 wherein computing the valley percentage feature includes:

positioning a second window over a plurality of filtered energy levels such that a first filtered energy level is positioned near a mid-point of the second window;

assigning to the valley percentage feature the percentage of the number of filtered energy levels that fall below a threshold energy level of the surrounding filtered energy levels viewed through the second window, as compared to the total number of filtered energy levels viewed through the second window;

repositioning the second window over a plurality of filtered energy levels to a next consecutive filtered energy level such that the next consecutive filtered energy level is positioned near a mid-point of the second window; and repeatedly performing the assigning and repositioning until all of the filtered energy levels of the energy component have been assigned, resulting in the valley percentage feature of the audio signal.

9. The method of claim 8 wherein the threshold energy level is selected by minimizing a difference between a known boundary of pure-speech and non-speech portions of a training audio signal and a test boundary determined across a parameter space.

10. The method of claim 8 wherein the second window is a duration of time selected by minimizing a difference between a known boundary of pure-speech and non-speech portions of a training audio signal and a test boundary determined across a parameter space.

11. The method of claim 8 wherein the pure speech versus non-speech classification is determined by assigning to a speech decision mask corresponding to each audio sample of the audio signal, a binary value of either:

zero to signify the presence of non-speech or mixed-speech, when the corresponding valley percentage feature is equal to or falls below a predetermined threshold valley percentage; or one to signify the presence of pure-speech, when the corresponding valley percentage feature rises above the predetermined threshold valley percentage.

12. The method of claim 11 wherein a boundary between the pure-speech and non-speech classifications is determined by:

discarding the values of the speech decision mask that are isolated, wherein the isolated value's neighboring values have an opposite value; and marking the boundaries between the remaining values of the speech decision mask equal to a binary one and the remaining values of the speech decision mask equal to a binary zero.

13. The method of claim 11 wherein the boundary between the pure-speech and non-speech classifications is determined by applying a morphological opening filter and a morphological closing filter to a speech decision mask, and marking the boundaries between a portion of the filtered speech decision mask having consecutive binary values of one, and a portion of the filtered speech decision mask having consecutive binary values of zero.

14. The method of claim 13 wherein the application of the morphological opening filter includes:

positioning a third window over a consecutive stream of values in the speech decision mask such that a first value is positioned near a mid-point of the third window;

eroding the first value to a minimum binary value of the surrounding values viewed through the third window;

repositioning the third window over a consecutive stream of values in the speech decision mask to a next consecutive value such that the next consecutive value is positioned near a mid-point of the third window;

repeatedly performing the eroding and repositioning until all of the values of the speech decision mask corresponding to each audio sample of the audio signal have been eroded;

positioning the third window over a consecutive stream of eroded values such that a first eroded value is positioned near a mid-point of the third window;

dilating the first eroded value to a maximum binary value of the surrounding eroded values viewed through the third window;

repositioning the third window over a consecutive stream of eroded values in the speech decision mask to a next consecutive value such that the next consecutive value is positioned near a mid-point of the third window; and repeatedly performing the dilating and repositioning until all of the values in the speech decision mask corresponding to each audio sample of the audio signal have been dilated, resulting in an opened speech decision mask corresponding to the audio signal.

15. The method of claim 14 wherein the application of the morphological closing filter includes:

positioning a fourth window over a consecutive stream of values in the opened speech decision mask such that a first opened value is positioned near a mid-point of the fourth window;

dilating the first opened value to a maximum binary value of the surrounding opened values viewed through the fourth window;

repositioning the fourth window over a consecutive stream of values in the opened speech decision mask to a next consecutive opened value such that the next consecutive opened value is positioned near a mid-point of the fourth window;

repeatedly performing the dilating and repositioning until all of the values in the opened speech decision mask corresponding to each audio sample of the audio signal have been dilated, resulting in a dilated opened speech decision mask corresponding to the audio signal;

positioning the fourth window over a consecutive stream of values in the dilated opened speech decision mask such that a first dilated opened value is positioned near a mid-point of the fourth window;

eroding the first dilated opened value to a minimum binary zero value of the surrounding dilated opened values viewed through the fourth window;

repositioning the fourth window over a consecutive stream of dilated opened values such that the next consecutive dilated opened value is positioned near a mid-point of the fourth window; and repeatedly performing the eroding and repositioning until all of the values in the dilated opened speech decision mask corresponding to each audio sample of the audio signal have been eroded, resulting in a closed speech decision mask corresponding to the audio signal.

16. A computer-readable medium on which is stored software for performing speech detection on an audio signal, the software, when executed by a computer, comprising instructions for:

storing a plurality of predetermined parameters for detecting pure-speech signals in an audio signal having pure-speech and non-speech or mixed-speech signals;

cleaning the audio signal to remove noise, wherein the audio signal comprises a plurality of audio samples in a first window, the first window having a size equal to one of the predetermined parameters;

computing from the clean audio signal a valley percentage, wherein the valley percentage is computed from a plurality of audio samples in a second window, the second window having a size equal to another one of the predetermined parameters, and wherein the valley percentage represents for an audio sample the number of audio samples in the second window having an energy level falling below a threshold energy level as compared to the total number of audio samples in the second window;

classifying the value of the valley percentage into either the pure-speech or non-speech classifications according to another one of the predetermined parameters; and determining the boundaries between a plurality of pure-speech and non-speech classifications by eliminating isolated pure-speech and non-speech classifications in a respective third and fourth windows, the third and fourth windows having sizes equal to another two of the predetermined parameters.

17. The computer-readable medium of claim 16 wherein cleaning comprises:

converting each audio sample in the first window into a corresponding energy level, the energy levels comprising an energy component; and applying a closing filter to the energy component resulting in a corresponding clean audio signal, where the clean audio signal retains distinct boundaries between pure-speech and non-speech portions, yet with less noise.

18. The computer-readable medium of claim 16 wherein the size of the first window is selected by minimizing a difference between a known boundary of pure-speech and non-speech portions of a training audio signal and a test boundary determined across a parameter space.

19. A computer-readable medium on which is stored software for performing speech detection on an audio signal, the software, when executed by a computer, comprising instructions for:

storing a plurality of predetermined parameters for detecting pure-speech signals in an audio signal having pure-speech and non-speech or mixed-speech signals;

cleaning the audio signal to remove noise, wherein the audio signal comprises a plurality of audio samples in a first window, the first window having a size equal to one of the predetermined parameters, the cleaning comprising:

converting each audio sample in the first window into a corresponding energy level, the energy levels comprising an energy component;

applying a closing filter to the energy component resulting in a corresponding clean audio signal, where the audio signal retains distinct boundaries between pure-speech and non-speech portions, yet with less noise;

computing from the clean audio signal a valley percentage, wherein the valley percentage is computed from a plurality of audio samples in a second window, the second window having a size equal to another one of the predetermined parameters, wherein the computing comprises:

determining a number of audio samples in the second window having an energy level falling below a threshold energy level, according to another one of the predetermined parameters; and setting the valley percentage equal to a percentage of the number of audio samples in the second window having an energy level falling below the threshold energy level, as compared to the total number of audio samples in the second window;

classifying the value of the valley percentage into either the pure-speech or non-speech classifications according to another one of the predetermined parameters; and determining the boundaries between a plurality of pure-speech and non-speech classifications by eliminating isolated pure-speech and non-speech classifications in a respective third and fourth windows, the third and fourth windows having sizes equal to another two of the predetermined parameters.

20. The computer-readable medium of claim 19, wherein the size of the second window is selected by minimizing a difference between a known boundary of pure-speech and non-speech portions of a training audio signal and a test boundary determined across a parameter space.

21. The computer-readable medium of claim 19 wherein the threshold energy level is calculated by:

determining a maximum energy level in the second window; and multiplying the maximum energy level by a fraction, the fraction having a value equal to another one of the predetermined parameters.

22. The computer-readable medium of claim 21 wherein the fraction is selected by minimizing a difference between a known boundary of pure-speech and non-speech portions of a training audio signal and a test boundary determined across a parameter space.

23. A computer-readable medium on which is stored software for performing speech detection on an audio signal, the software, when executed by a computer, comprising instructions for:

storing a plurality of predetermined parameters for detecting pure-speech signals in an audio signal having pure-speech and non-speech or mixed-speech signals;

cleaning the audio signal to remove noises wherein the audio signal comprises a plurality of audio samples in a first window, the first window having a size equal to one of the predetermined parameters;

computing from the clean audio signal a valley percentage, wherein the valley percentage is computed from a plurality of audio samples in a second window, the second window having a size equal to another one of the predetermined parameters;

classifying the value of the valley percentage into either the pure-speech or non-speech classifications according to another one of the predetermined parameters, wherein the classifying comprises:

comparing the value of the valley percentage to a threshold valley percentage, the threshold valley percentage having a value equal to another one of the predetermined parameters; and setting a value in a binary decision mask corresponding to the value of the valley percentage to a value of zero where the valley percentage is equal to or less than the threshold valley percentage, or to a value of one where the valley percentage is greater than the threshold valley percentage; and determining the boundaries between a plurality of pure-speech and non-speech classifications by eliminating isolated pure-speech and non-speech classifications in a respective third and fourth windows, the third and fourth windows having sizes equal to another two of the predetermined parameters.

24. The computer-readable medium of claim 23 wherein the value of the predetermined threshold valley percentage is selected by minimizing a difference between a known boundary of pure-speech and non-speech portions of a training audio signal and a test boundary determined across a parameter space.

25. The computer-readable medium of claim 24 wherein the size of the third window is selected by minimizing a difference between a known boundary of pure-speech and non-speech portions of a training audio signal and a test boundary determined across a parameter space.

26. The computer-readable medium of claim 24 wherein the size of the fourth window is selected by minimizing a difference between a known boundary of pure-speech and non-speech portions of a training audio signal and a test boundary determined across a parameter space.

27. A computer-readable medium on which is stored software for performing speech detection on an audio signal, the software, when executed by a computer, comprising instructions for:

storing a plurality of predetermined parameters for detecting pure-speech signals in an audio signal having pure-speech and non-speech or mixed-speech signals;

cleaning the audio signal to remove noise, wherein the audio signal comprises a plurality of audio samples in a first window, the first window having a size equal to one of the predetermined parameters, the cleaning comprising:

converting each audio sample in the first window into a corresponding energy level, the energy levels comprising an energy component;

applying a closing filter to the energy component resulting in a corresponding clean audio signal, where the audio signal retains distinct boundaries between pure-speech and non-speech portions, yet with less noise, wherein the applying includes:

dilating the energy levels of the energy component in the first window; and eroding the dilated energy levels of the energy component in the first window;

computing from the clean audio signal a valley percentage, wherein the valley percentage is computed from a plurality of audio samples in a second window, the second window having a size equal to another one of the predetermined parameters;

classifying the value of the valley percentage into either the pure-speech or non-speech classifications according to another one of the predetermined parameters; and determining the boundaries between a plurality of pure-speech and non-speech classifications by eliminating isolated pure-speech and non-speech classifications in a respective third and fourth windows, the third and fourth windows having sizes equal to another two of the predetermined parameters.

28. A computer-readable medium on which is stored software for performing speech detection on an audio signal, the software, when executed by a computer, comprising instructions for:

storing a plurality of predetermined parameters for detecting pure-speech signals in an audio signal having pure-speech and non-speech or mixed-speech signals;

cleaning the audio signal to remove noise, wherein the audio signal comprises a plurality of audio samples in a first window, the first window having a size equal to one of the predetermined parameters;

computing from the clean audio signal a valley percentage, wherein the valley percentage is computed from a plurality of audio samples in a second window, the second window having a size equal to another one of the predetermined parameters;

classifying the value of the valley percentage into either the pure-speech or non-speech classifications according to another one of the predetermined parameters; and determining the boundaries between a plurality of pure-speech and non-speech classifications by eliminating isolated pure-speech and non-speech classifications in a respective third and fourth windows, the third and fourth windows having sizes equal to another two of the predetermined parameters, wherein the determining comprises:

applying a morphological opening filter to the plurality of pure-speech and non-speech classifications in the third window; and applying a morphological closing filter to the plurality of pure-speech and non-speech classifications in the fourth window.

29. A method for extracting speech detection features in an audio signal having a mixture of speech and non-speech audio samples, the method comprising:

determining an energy level for each of plural audio samples in an audio signal;

extracting a speech detection feature for each of the plural audio samples by, determining a maximum energy level in a range of plural surrounding audio samples;

calculating a threshold energy level as a fraction of the maximum energy level; and setting the speech detection feature based upon a percentage of the plural surrounding audio samples that have an energy level falling below the threshold energy level.

30. The method of claim 29 further comprising:

before extracting, filtering the audio signal to clean the audio signal while preserving boundary distinctions in the audio signal.

31. The method of claim 29 further comprising:

after extracting, classifying the plural audio samples of the audio signal as speech or non-speech based upon comparison of the extracted speech detection features to a speech detection feature threshold.

32. A computer readable medium on which is stored software for extracting speech detection features for an audio signal having a mixture of speech and non-speech audio portions, the software comprising instructions for:

determining an energy level for each of plural audio samples in an audio signal;

filtering the audio signal to clean the audio signal while preserving boundary distinctions in the audio signal; and extracting a speech detection feature for each of plural portions of the filtered audio signal, each portion including one or more audio samples, each speech detection feature based upon a percentage of surrounding portions of the filtered audio signal that have an energy level falling below a threshold energy level for the surrounding portions.

33. The computer readable medium of claim 32 wherein the filtering uses a closing filter that comprises a dilation operator followed by an erosion operator.

34. A method for extracting speech detection features for an audio signal having a mixture of speech and non-speech audio portions, the method comprising:

determining an energy level for each of plural audio samples in an audio signal;

extracting a speech detection feature for each of plural portions of the audio signal, each portion including one or more audio samples, each speech detection feature based upon a percentage of surrounding portions of the audio signal that have an energy level falling below a threshold energy level for the surrounding portions;

setting a classification for each of the plural portions as speech or non-speech based upon a comparison of the extracted speech detection feature for the portion to a speech detection feature threshold; and filtering the classifications to remove isolated classifications, wherein an isolated classification has a value differing from a predominant value for surrounding classifications, and wherein the filtering uses one or more morphological filters.

35. The method of claim 34 wherein the filtering uses an opening filter followed by a closing filter.

* * * * *